United States Patent [19]

Lay et al.

[11] Patent Number: 4,735,333

[45] Date of Patent: Apr. 5, 1988

[54] INSULATED HOLDER

[75] Inventors: Terry W. Lay; Carol A. Stieffermann, both of 7004 Jamieson, Apt. 1N, St. Louis, Mo. 63109

[73] Assignee: Terry W. Lay, St. Louis, Mo.

[21] Appl. No.: 941,024

[22] Filed: Dec. 12, 1986

[51] Int. Cl.[4] ..... A47G 19/00

[52] U.S. Cl. ..... 220/90.2; 220/90.4; 220/85 H

[58] Field of Search ..... 220/90.2, 90.4, 85 H, 220/411, 412, 3.1

[56] References Cited

U.S. PATENT DOCUMENTS 2,896,812 7/1959 Paprocki ..... 220/85 H
3,257,025 6/1966 Jolly ..... 220/85 H
3,905,511 9/1975 Groendal ..... 220/90.2
4,127,211 11/1978 Zerbey ..... 220/85 H X
4,561,563 12/1985 Woods ..... 220/412
4,615,463 10/1986 Price et al. ..... 220/90.4 X

*Primary Examiner*—Steven M. Pollard
*Attorney, Agent, or Firm*—Senniger, Powers, Leavitt and Roedel

[57] ABSTRACT

A container (1) for a can (C) has a hollow cylinder (3) having an inner diameter substantially equal to the outer diameter of the can. A base (5) at the lower end of the cylinder has a flat bottom surface so the container will sit on a table or the ground. A lid (19) fits over the upper end of the cylinder. A hinge structure (21) permits a user to lift the lid to open or drink from the can.

15 Claims, 1 Drawing Sheet

FIG. 1.
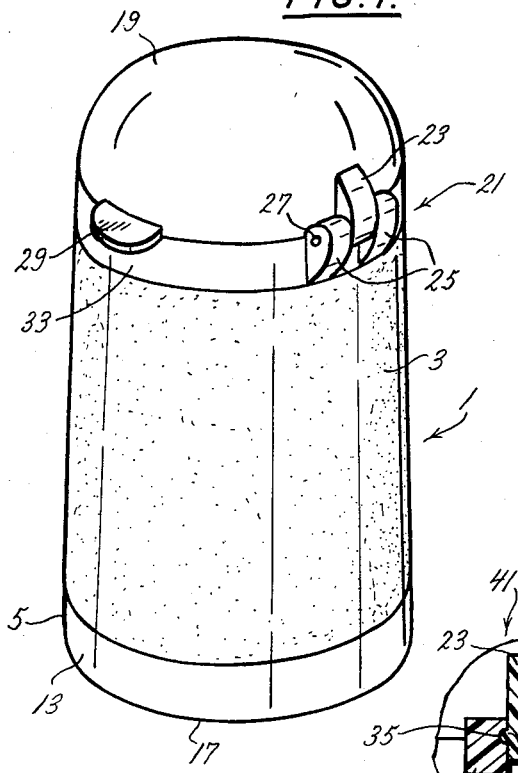
FIG. 2.
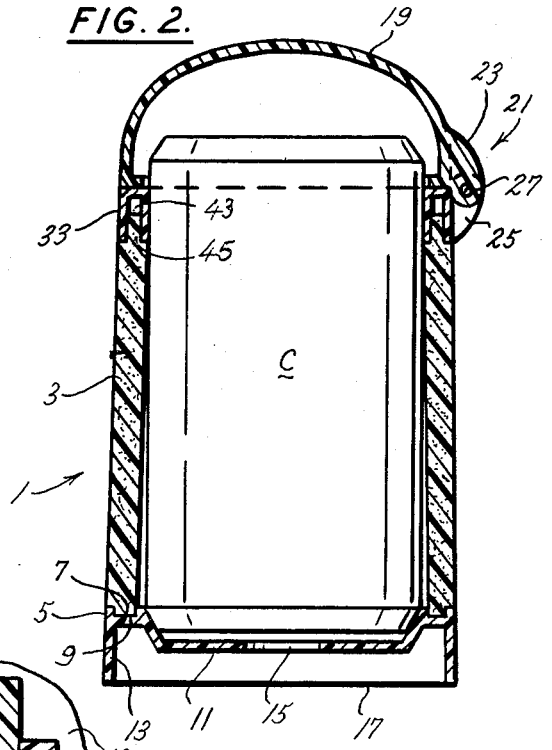
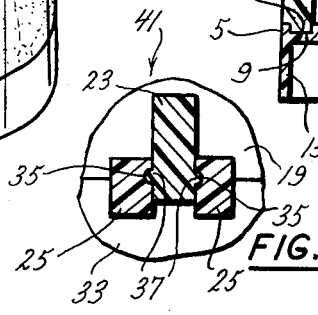
FIG. 5.
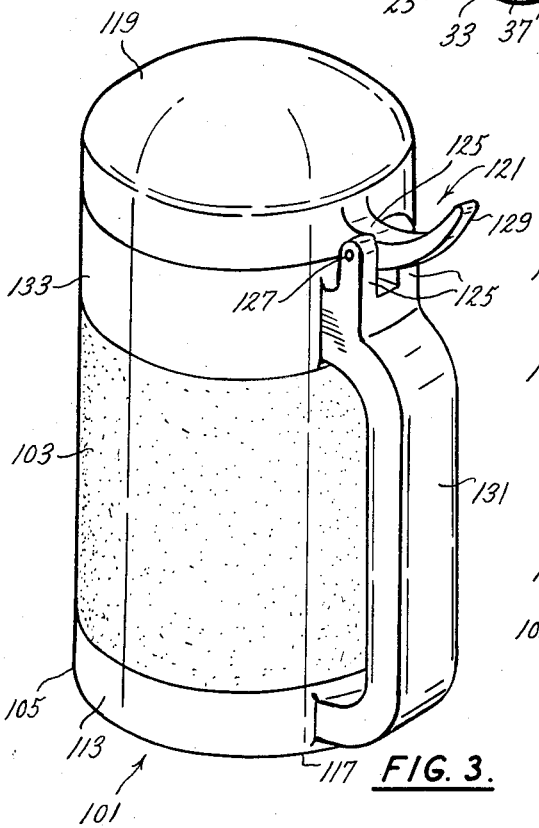
FIG. 3.
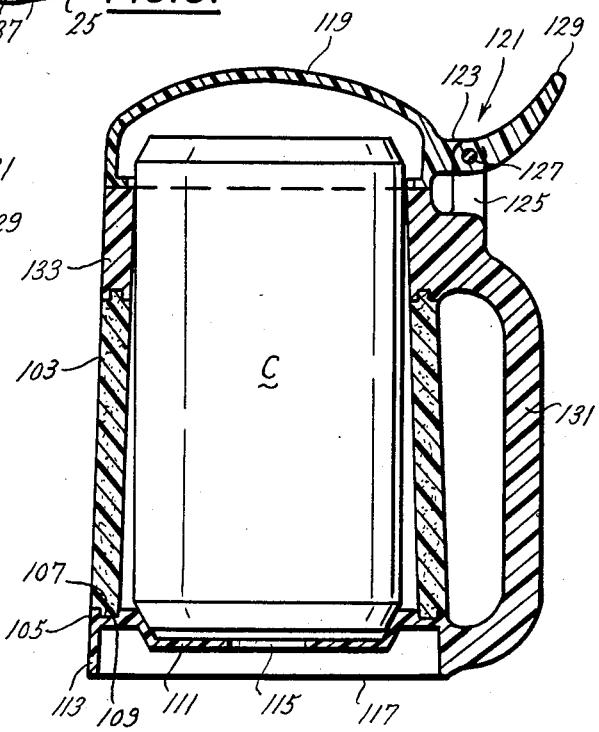
FIG. 4.

INSULATED HOLDER

BACKGROUND OF THE INVENTION

This invention relates to a device for holding soda or beer cans or the like.

The beer can and soda can are a fixture on the American scene. These metal, typically 12 ounce metal cans, with the pull tab are seen and used everywhere; at home, at work, at sporting events, picnics and parties. The beverage contained in these cans are usually drunk cold and for this reason the cans are kept in a refrigerator or refrigerated unit or on ice. Upon removal from the refrigerated unit the can and beverage are exposed to a warmer temperature which, over time, may warm the beverage, for example beer or soda, to a point where the beverage is less enjoyable to the drinker than when cold. Also, the cans tend to be wet on the outside because of condensation or water from melting ice if the cans have been iced. This makes the cans slippery to hold and may also require the drinker to keep drying his hands every time after he sets the can down.

Insulated sleeves are known in the prior art formed from foam, rubber or the like but such sleeves offer only limited insulation protection. Also known are covered containers such as that shown in U.S. Pat No. 3,120,319 but such containers are provided with a screw-on cap which cannot readily be removed without using two hands. Insulated lined pitchers are also known such as those shown in U.S. Pat. No. 3,094,448 and U.S. Pat. No. 3,861,568 but these units are intended to receive liquid directly and not to provide a receptacle for a can.

The present invention overcomes these and other problems in a manner not disclosed in the known prior art.

SUMMARY OF THE INVENTION

To aid the beer or soda drinker, the present invention is an insulated holder for the cans. The holder is rigid to accomodate a beer or soda can and is made to sit on a table or the ground without tipping. By placing a can in the holder, the drinker avoids the wetness problem. Also, the holder has a lid which both aids in keeping the can cooler longer, and prevents dirt or insects from getting into the can. For aesthetic purposes, the holder and its lid can be formed to resemble a classic stein.

This holder can holder includes a hollow cylinder of insulating material having an inner diameter substantially equal to the outer diameter of the can for the can to be placed in the cylinder; a base at the lower end of the cylinder having a substantially flat bottom surface so the container will set on a table or the ground; a lid fitting over the upper end of the cylinder; and hinge means to lift the lid with one hand and allow a person to open a can set inside the container or drink from it.

It is an aspect of this invention that the lid includes a projection on its outer surface adjacent the surface abutting the upper end of the cylinder and that the hinge means includes a pair of projections between which the first said projection protrudes.

It is another aspect of this invention that the inner face of each projection of the pair of projections has an indentation and the abutting faces of the first said projection each has a nib received in the identations to form an axis about which the lid pivots.

Still another aspect of this invention is that the lid has an outwardly extending finger tab operable by the user to lift the lid.

A further aspect of this invention is that the first said projection curves outwardly beyond the axis to provide a finger operable tab for the user to lift the lid.

Another aspect of this invention is to provide a handle, the pair of projections formed with the cylinder being formed on the upper end of the handle.

In another aspect of this invention the lid is generally hemispheric in shape.

It is an aspect of this invention that the holder is relatively simple and inexpensive to manufacture and easy to use.

BRIEF DESCRIPTION OF THE DRAWINGS

FIG. 1 is a perspective view of a first embodiment of a container of the present invention;

FIG. 2 is a cross-sectional view of the container of FIG. 1;

FIG. 3 is a perspective view of a second embodiment of the container of the present invention;

FIG. 4 is a cross-sectional view of the container of FIG. 3, and

FIG. 5 is a partial sectional view of an attachment arrangement for affixing a lid on the container.

DESCRIPTION OF THE PREFERRED EMBODIMENT

Referring now by reference numerals to the drawing and first to FIGS. 1 and 2 it will be understood that insulated holder for a can C of beer or soda or the like is indicated generally by reference numeral 1. The holder comprises a hollow cylinder 3 having an open upper end and a lower end. The cylinder is made of insulating material such as styrofoam or similar relatively rigid insulative material. Cylinder 3 has an inner diameter which is substantially equal to the outer diameter of can C. As shown in FIG. 2, cylinder 3 is formed, as by molding, so that the bottom has a slightly larger inner diameter than the top. Can C therefore is easily placed in the container by a drinker when full or first opened, and easily removed when empty.

Holder 1 has a base 5, preferably formed from polyvinyl chloride, polypropylene or the like, which supports the the cylinder 3. The lower end of cylinder 3 has a circumferential shoulder 7 and an upper end of base 5 has circumferentially formed mating surface 9. The cylinder may be attached to the base, for example, by force fitting the pieces together, or using a glue or an ultrasonic or heat-seal weld. Base 5 includes a deck 11 having a tapered portion upon which the bottom of can C rests. Deck 11 may be integrally formed with the outer cylindrical skirt 13 of the base and may be a solid web of material. Preferably however, the deck has an opening 15 therein for permitting liquid from the sides of the can to drain out the bottom of the holder. The opening 15 also facilitates the insertion of the can by providing for the escape of air. The outer cylindrical skirt 13 of the base is slightly flared so the base of the holder is bigger in diameter than the top. This provides stability. The bottom surface 17 of the skirt is flat so the holder can be set upon a table or the ground without tipping.

The holder 1 includes an annular upper end or support for the cylinder 3. Support 33 is force fitted, glued or otherwise attached to the cylinder 3 by fitting the tongue 43 into the mating portion 45. Importantly, the holder has a dome-shaped lid 19 fitting over the upper end 34 of cylinder 3. The lid may be generally hemispheric in shape as the lid 19 shown in FIGS. 1 and 2, or relatively flat. The upper end 33 and the lid 19 are preferably formed from the same material as the skirt 5.

The lid 19 is mounted via hinge means 21 for pivotal movement with respect to the annular support 33 for swinging between a closed position for covering the open end of cylinder 3 and the top of a can within the cylinder, and an open position to permit access to the can within the cylinder. The arrangement is such as to enable a drinker to lift the lid 19 with the same hand that holds the container. To this end, the lid 19 has a projection 23 formed on its outer surface abutting the upper end of cylinder 3. A pair of projections 25 are formed on the annular support 33 and projection 23 fits between these projections. A pin 27 fits through all three projections to form an axis about which lid 19 pivots. A finger operable tab 29 extends horizontally from the edge of lid 19 fo facilitate the drinker's raising of the lid.

A modified holder 101 is shown in FIGS. 3 and 4. Similar parts are identified by the same reference numeral with the addition of prefix 100. The holder is generally similar to that described above in that it includes a flared cylinder 103, a lower base 105, an upper annular support 133, and a lid 119.

However, in this embodiment the holder has a handle 131 which may be integrally formed with cylinder 103 or, as shown in FIGS. 3 and 4, as an integral unit having a lower section incorporating base 105 and an upper section incorporating annular support 133 and formed from the same material. Cylinder 103, as in the previous embodiment, fits between the base 105 and support 133. Lid 119 has a projection 123 which protrudes between a pair of upright projections 125 that extend upwardly from the upper end of handle 131. Pin 127 extends through all three projections to form an axis about which lid 119 pivots. In this embodiment projection 123 curves outwardly beyond projections 125 and forms a finger operable tab 129 for the user to lift lid 119.

An alternate hinge means 41 is indicated in FIG. 5. Here, projections 25 each have an indentation 35 formed on their inner face and the abutting faces of projection 23 have a nib 37 rotatably fitting in the indentations to form an axis about which a lid pivots. This arrangement provides that the lid may be snapped into place and removed as desired. The modified holder 101 may similarly be provided with the alternate hinge means.

It will be noted that the holder 1 shown in FIGS. 1 and 2 is a utilitarian design while that shown in FIGS. 3 and 4 is more decorative in appearance being more the shape of a stein.

Having described the invention in detail, those skilled in the art will appreciate that modifications may be made without departing from its spirit. Therefore, it is not intended that the scope of the invention be limited to the specific embodiments illustrated and described. Rather it is intended that the scope of this invention be determined by the appended claims and their equivalents.

I claim as my invention:

1. An insulated holder for holding a can of beer or soda or the like, comprising a hollow cylinder of insulating material having an inner diameter substantially equal to the outer diameter of the can for the can to be placed in the cylinder; a base for supporting the lower end of the cylinder having a substantially flat bottom surface so the holder will set on a table or the ground; an annular support spaced above the base for supporting the cylinder adjacent its upper end; a lid fitting over the upper end of the cylinder; and hinge means mounting the lid for swinging between a closed position covering the top of the cylinder and an open position to allow a person to open a can set inside the holder or drink from it, further comprising a handle connecting said base and said annular support to form a relatively rigid framework.

2. The holder of claim 1 wherein said hinge means comprises a first projection on the lid and a pair of projections adjacent said annular support between which said first projection protrudes.

3. The holder of claim 2 wherein said hinge means further includes a pin extending through all three projections and forming an axis about which the lid pivots.

4. The holder of claim 2 wherein the inner face of each projection of said pair of projections has an indentation and the abutting faces of said first projection have nibs received in the indentations to form an axis about which the lid pivots.

5. The holder of claim 2 wherein the lid has a horizontally extending finger tab operable by the user to lift the lid.

6. The holder of claim 2 wherein said first projection curves outwardly beyond the axis to provide a finger operable tab adapted to be pressed down to swing the lid open.

7. The holder of claim 6 further including a handle, said pair of projections being formed on the upper end of the handle.

8. The holder of claim 1 wherein the lid is hemispheric in shape.

9. The holder of claim 1 wherein said base comprises a deck engageable by the lower end of said cylinder, and a skirt at the periphery of the deck.

10. The holder of claim 9 wherein the deck has an air escape opening therein.

11. An insulated holder for holding a container such as a can of beverage, comprising a hollow cylinder of insulating material having an open upper end, a lower end, and an inside diameter substantially equal to the outer diameter of said container for placement of the container within the cylinder through the open upper end of the cylinder, an annular support for supporting the hollow cylinder adjacent its open upper end, and a lid mounted for pivotal movement with respect to the support for swinging between a closed position for covering the open upper end of the cylinder and the top of a container within the cylinder, and an open position to permit access to the container within the cylinder, further comprising a base for supporting the lower end of said hollow cylinder, and handle means connecting the base and said annular support.

12. An insulated holder as set forth in claim 11 wherein the lid abuts said annular support around the entire periphery of the support when the lid is in its closed position.

13. An insulated holder as set forth in claim 12 wherein said lid is pivoted on said annular support.

14. An insulated holder as set forth in claim 11 wherein said base, said handle means and said annular support are integrally formed.

15. An insulated holder as set forth in claim 14 wherein said lid is pivoted on said annular support.

* * * * *